US006393644B1

(12) United States Patent
Weaver

(10) Patent No.: US 6,393,644 B1
(45) Date of Patent: May 28, 2002

(54) BRIDGE JOINT

(75) Inventor: Brian F. Weaver, Burlington, KY (US)

(73) Assignee: Progress Rail Services Corp., St. Petersburg, FL (US)

( * ) Notice: Subject to any disclaimer, the term of this patent is extended or adjusted under 35 U.S.C. 154(b) by 0 days.

(21) Appl. No.: 09/635,152

(22) Filed: Aug. 8, 2000

(51) Int. Cl.[7] ..... E01B 11/00; E01D 19/06

(52) U.S. Cl. ..... 14/73.1; 14/73.5; 238/47; 238/171

(58) Field of Search ..... 14/73.1, 73.5, 14/77.1; 238/47, 151, 171, 175, 179, 182, 190, 192, 194, 218, 228, 258

(56) References Cited

U.S. PATENT DOCUMENTS 2,067,695 A 1/1937 Conley ..... 238/171
3,008,644 A * 11/1961 Wagner ..... 238/171
4,171,774 A * 10/1979 Deslauriérs ..... 238/171
4,785,994 A 11/1988 Crone et al. ..... 238/171
5,590,833 A * 1/1997 Benenowski et al. ..... 238/171
5,651,499 A 7/1997 Mihailoff et al. ..... 238/22

* cited by examiner

*Primary Examiner*—Gary S. Hartmann
(74) *Attorney, Agent, or Firm*—Bracewell & Patterson, L.L.P.

(57) ABSTRACT

A bridge joint for use with a railroad track having standard rail sections with flanges. The bridge joint includes a fixed point having a forward integral accepting portion with a point and flanges rearward of the accepting portion. The joint also has a moveable body having a forward interface portion adapted to be slidingly accepted in the accepting portion. The moveable body has a notch adapted to accept the point. Clamping lugs are positioned on the accepting portion and the interface portion. The fixed point and the moveable body are clamped to base plates and quick release fasteners are positioned to engage the flanges of the fixed point, moveable body, and a flange of each of the standard rail sections and secure all to the base plates.

16 Claims, 3 Drawing Sheets

BRIDGE JOINT

TECHNICAL FIELD

This invention relates to a bridge joint. More specifically, this invention relates to a bridge joint having cast members which can be easily removed and replaced.

BACKGROUND ART

Bridge joints are commonly used along a railroad track to allow a bridge structure to raise and lower. Bridge joints of the prior art have included a body section and point section that maintain a substantially continuous surface on which the rail car rides. These sections are joined to the support substrate with planar base plates which are usually bolted to the support substrate and many times are integral to the sections. As the sections wear from rail car traffic they must periodically be removed and replaced. To remove such integral sections, the base plates must also be removed, which is a time consuming, costly process.

Other prior art bridge joints have sections that are bolted to the base plates. However, because these designs incorporate bolts that pass through the base plates, access to the underside of the base plates is required to remove the cast sections. If access is unavailable, the base plates must be removed with the rail sections before the sections can be removed from the base plates.

Thus, there is a need for a bridge joint having cast sections that can be easily and inexpensively replaced without requiring removal of the base plates.

SUMMARY OF THE INVENTION

The present invention is directed to a bridge joint having a cast section that can be removed from the base plates and replaced without access to the underside of the base plates or bridge structure. The bridge joint has a first and second planar base plates. A point section is on the first base plate and has a forward integral accepting portion with a point and flanges rearward of the accepting portion. A body section on the second base plate has a forward interface portion adapted to be slidingly accepted in the accepting portion. Body section has a notch adapted to accept the point and flanges rearward of the interface portion. A plurality of fasteners are secured to the base plates for engaging the flanges and securing the point section to the first base plate and the body section to the second base plate. The fasteners are operated from an upper side. The fasteners have a spring clips for engaging the flanges. The quick release fasteners have a base and the flanges have notches adapted to engage the base.

A plurality of clamping lugs are positioned on the point section and the body section. A plurality of clamps correspond to the clamping lugs. The clamps have clamping members adapted to engage and restrain vertical and horizontal movement of the clamping lugs and are releasably secured to the base plates. There are clamping lugs on the accepting portion. There are clamping lugs on the interface portion.

The point section has a rearward standard rail mating portion adapted to laterally abut and join with one of the standard rail sections. The body section has a rearward standard rail mating portion adapted to laterally abut and join with one of the standard rail section. The standard rail section has a flange opposed to the mating section which is secured to the base plate with the quick release fasteners.

The forward accepting portion has spaced side walls positioned closely adjacent to the interface portion.

The present invention is also directed to a method of allowing for movement of a railway bridge. The railway has standard rail sections with flanges. A point section is provided having an accepting portion, a standard rail mating portion, and flanges. A body section is provided having an interface portion, a standard rail mating portion, and flanges. A first and second base plates are provided with clamps and quick release fasteners thereon. The interface portion is placed in the accepting portion. One standard rail section is secured to the mating portion of the point section and another standard rail section is secured to the mating portion of the body section. The point section and joined standard rail section are positioned on the first base plate and the body section and joined standard rail section are positioned on the second base plate. The accepting portion is clamped to the first base plate and the interface portion is clamped to the second base plate. The quick release fasteners are engaged with a flange of the point section, a flange of the body section, and a flange of each of the standard rail sections to secure the point section, body section, and standard rail section to the base plates.

BEST MODE FOR CARRYING OUT THE INVENTION

Figure 1:
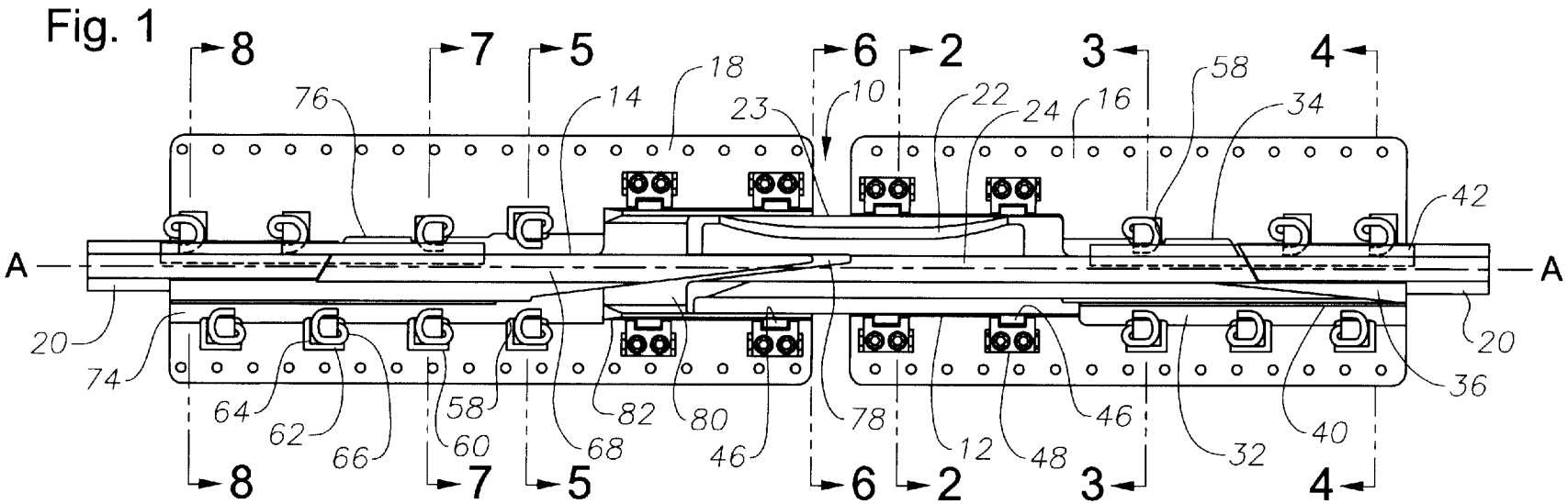
FIG. 1 is a top plan view of a bridge joint constructed in accordance with this invention.

Referring to FIG. 1, a bridge joint 10 constructed in accordance with this invention has generally a moveable body section 12 interfacing with a fixed point section 14. Moveable body section 12 is joined to a planar body base plate 16 and fixed point section 14 is joined to a planar point base plate 18. Standard rail sections 20 abut the ends of moveable body section 12 and fixed point 14 sections and are joined to base plates 16, 18. Moveable body section 12, fixed point 14, and standard rail 20 sections align on longitudinal rail axis A. One bridge joint 10 is used to join one run of standard rail 20, thus in a conventional railway having parallel paired rails 20, two bridge joints 10 would be used at each desired point.

Moveable body section 12 is large cast piece with integral features thereon. When viewed from above (FIG. 1) moveable body section 12 has two distinct portions, a guard 22 and body member 24. Body member 24 is centered about axis A with a top surface that is substantially continuous with the top surface of standard rail 20 and generally forms the surface that a rail car rides on. Guard 22 is an integrally formed component of body section 12 that runs generally longitudinally alongside axis A, curves toward axis A in the center, and outward at both ends. Guard 22 is positioned on a forward portion of moveable body section 12 and together with body member 24, forms a forward interface section 23.

Figure 2:
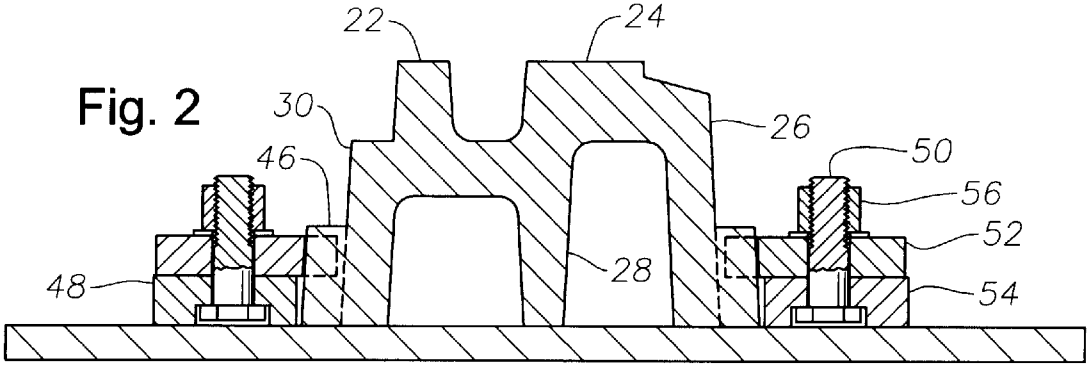
FIG. 2 is a cross sectional view taken along line 2—2 of FIG. 1.
Figure 3:
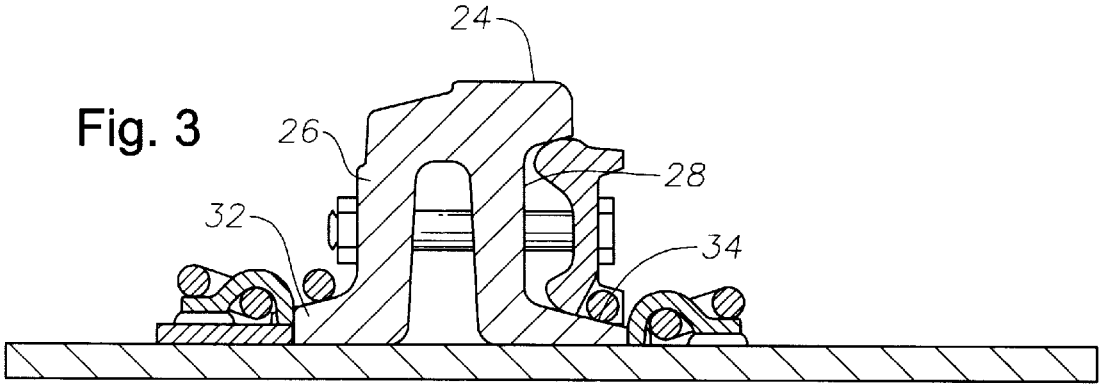
FIG. 3 is a cross sectional view taken along line 7—7 of FIG. 1.
Figure 4:
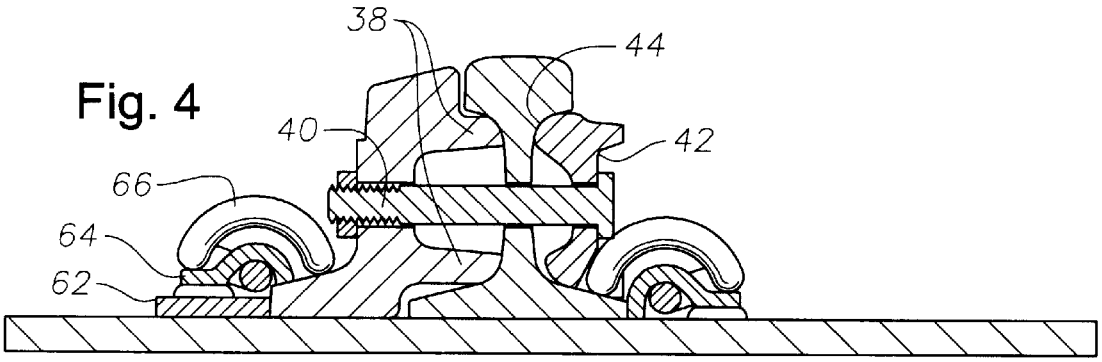
FIG. 4 is a cross sectional view taken along line 8—8 of FIG. 1

As seen in FIG. 2, body member 24 is supported by outer body web 26 and inner body web 28, and guard 22 is supported by guard web 30. Rearwards of guard 22, the lower ends of outer and inner body webs 26, 28 flare away from axis A to form an outer flange 32 and an inner flange 34 (FIG. 3). As seen in FIG. 1, the rearward end of body section 12 is angled relative to axis A to accept standard rail 20 with a mating angle and the termination inner body web 28. Outer body web 26, outer flange 32, and a portion of body member 24 extend rearward to form a standard rail mating section 36. Referring to FIG. 4, mating section 36 has lateral projections 38 adapted to laterally abut and secure standard rail section 20. Rearwards of guard 22, webs 26, 28 have transverse bolt holes 40 through which a clamping member 42 is bolted (FIG. 1). Clamping member 42 has lateral projections 44 adapted to laterally abut and secure standard rail section 20. Standard rail section 20 is placed between mating section 36 and clamping member 42 and bolted to moveable body section 12 through bolt holes 40. Clamping member 42 is also independently bolted to body section 12.

Referring again to FIG. 1, the central portion of body section 12 has a plurality of clamping lugs 46 integrally formed on guard web 30 and outer body web 26. Clamping lugs 46 are substantially rectangular, but narrow slightly near their top as measured parallel to axis A. A plurality of clamps 48 correspond to clamping lugs 46 and can be seen in FIG. 2. Clamps 48 consist of one or more threaded members 50, a clamping member 52, and a clamp base 54. Clamp base 54 is secured to base plate 16 and holds threaded member 50 to face upward. A clamping member 52 adapted to engage and retain vertical and horizontal movement of clamping lug 46 is placed over threaded member 50 and secured with a nut 56. With nut 56 tightened on clamping member 52, body section 12 is secured to body base plate 16. Secured body section 12 is positioned so that a portion of forward interface section 23 extends off of base plate 16.

Referring to FIG. 1, a plurality of notches 58 in flanges 32, 34 partially accept corresponding quick release fasteners 60 secured to base plate 16. Fasteners 60 are quick release rail fasteners known to those skilled in the art. Each fastener 60 is secured to a stop block 62 (FIG. 4) which is secured to base plate 16. Stop block 62 engages notch 58 and prevents movement of moveable body section 12 along axis A. Fastener 60 has a shoulder plate 64 joined to stop block 62 and a spring clip 66 arranged such that spring clip 66 can be driven into shoulder plate 64 and a portion of spring clip 66 will exert a downward force on moveable body section 12 thus securing moveable body section 12 to base plate 16. Additional quick release fasteners 60 secured to base plate 16 are provided to secure standard rail section 20. These additional fasteners 60 are not on stop plates 62, but are attached directly to base plate 16.

Figure 5:
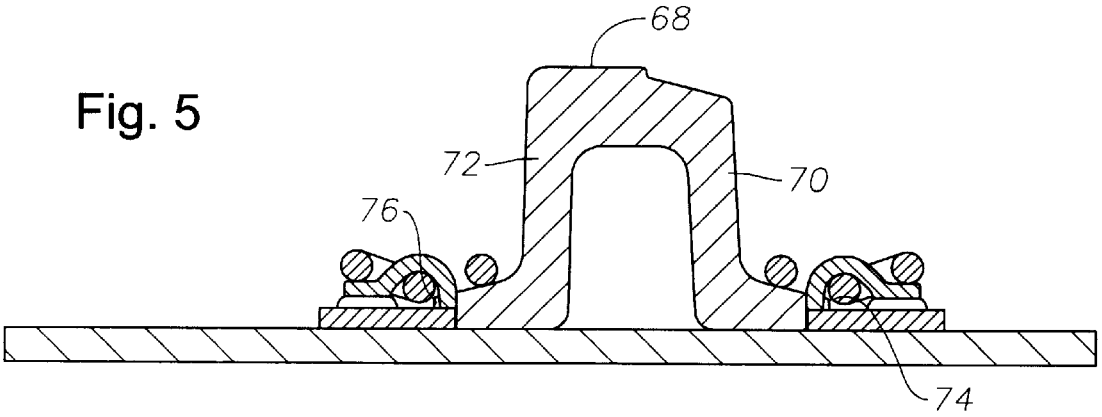
FIG. 5 is a cross sectional view taken along line 5—5 of FIG. 1.
Figure 6:
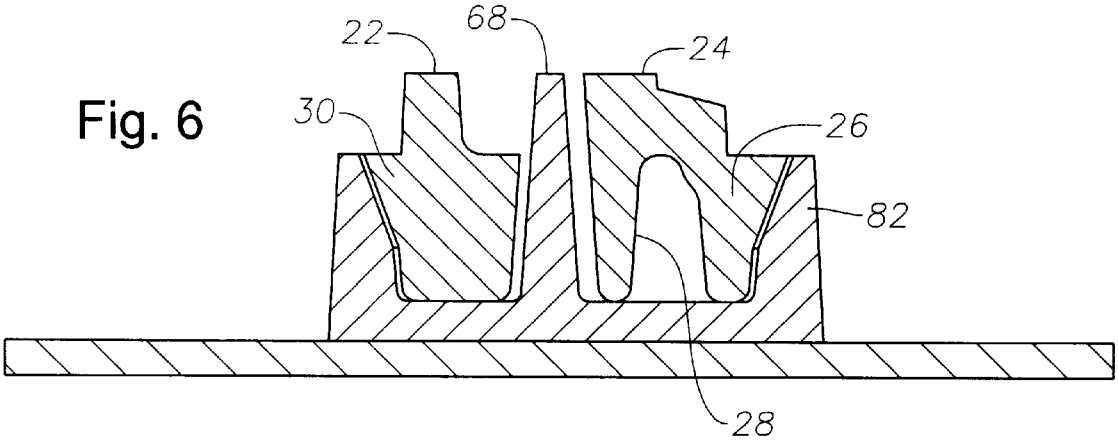
FIG. 6 is a cross sectional view taken along line 6—6 of FIG. 1.
Figure 7:
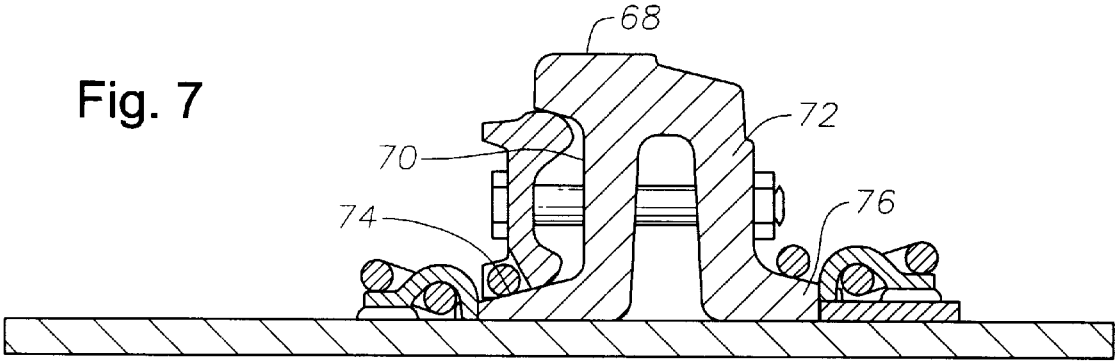
FIG. 7 is a cross sectional view taken along line 3—3 of FIG. 1.
Figure 8:
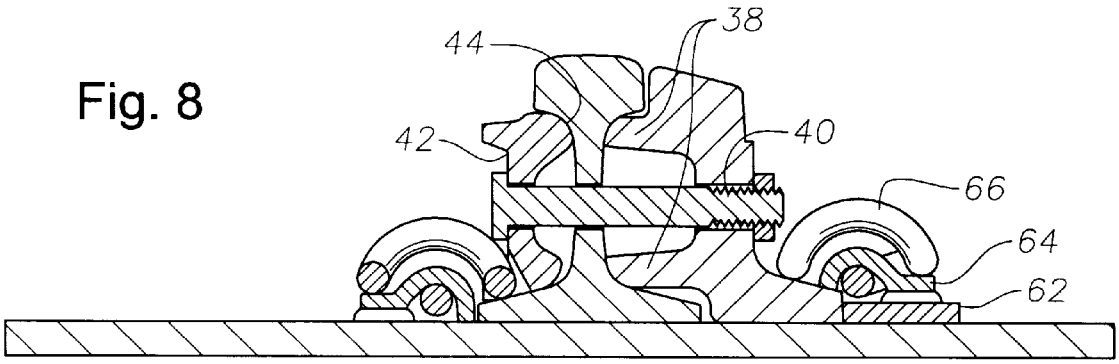
FIG. 8 is a cross sectional view taken along line 4—4 of FIG. 1.

Fixed point section 14 is a large cast piece with integral features fixed point section 14 has a point member 68 centered about axis A and substantially continuous with the top surface of standard rail 20 and body member 24. As seen in FIG. 5, point member 68 is supported by an outer point web 70 and inner point web 72. The lower ends of outer and inner fixed point webs 70,72 flare away from axis A to from an outer flange 74 and an inner flange 76. Referring again to FIG. 1, the rearward end of fixed point 14 is angled like the rearward end of moveable body section 12 to accept standard rail 20 with a mating angle and the termination of inner point web 72. Outer point web 70, outer flange 74, and a portion of point member 68 extend rearward to form a standard rail mating section 36 as described above. Standard rail 20 is placed abutting mating section 36. A clamping member 42 is bolted to fixed point 14 and standard rail 20 as discussed above.

Opposite mating section 36 of fixed point section 14 is an integral accepting portion 80 which slidingly accepts interface section 23 of moveable body section 12. Point member 68 narrows at an acute angle relative to axis A and interface section 23 has a corresponding notch 78 adapted to accept point member 68. Accepting portion 80 has spaced side walls 82 adapted to closely abut forward interface section 23 and maintain its alignment about axis A. Accepting portion 80 has a plurality of spaced clamping lugs 46 as described above and corresponding clamps 48 on base plate 18 secure it to point base plate 18. A plurality of quick release fasteners 60 on stop blocks 62 attached to base plate 18 reside in notches 58 in the rearward portion of fixed point section 14 and secure fixed point 14 to base plate 18. Additional fasteners 60 not on stop blocks secure standard rail section 20.

Though the above embodiment is disclosed using the preferable combination of clamps 48 and quick release fasteners 60, it is also possible to use entirely clamps 48 or entirely quick release fasteners 60 to hold the body section 12 and point section 14 to their respective base plates.

In operation, moveable body section 12 is secured to body base plate 16 and fixed point section 14 is secured to point base plate 18 and are free to move relative to each other with their respective base plates 16, 18 along axis A while remaining substantially continuous. As moveable body section 12, fixed point 14, and standard rail 20 wear, they can be removed and replaced without removing base plates 16, 18 from the bridge or structure to which they are attached. Bridge joint 10 is disassembled by loosening nuts 56 and disassembling clamps 52. No access beneath base plates 16, 18 is required. Standard rail section 20 is unbolted from mating sections 36 of moveable body section 12 and fixed point section 14, and rail clamping members 42 are removed. Quick release fasteners 60 are released by driving spring clips 66 out of shoulder plates 64. Moveable body section 12 and fixed point section 14 can then be lifted vertically from base plates 16, 18 and scrapped. Standard rail sections 20 can also be removed as they are no longer secured to base plates 16, 18.

Bridge joint 10 can be reassembled by positioning the forward end of moveable body section 12 in the accepting portion 80 of fixed point section 14. Moveable body section 12 and fixed point section 14 are then placed on body base plate 16 and point base plate 18 respectively. Clamps 48 are assembled and nuts 56 are tightened, partially securing moveable body section 12 and fixed point section 14 to their respective base plates 16, 18. Standard rail section 20 is placed abutting mating section 36 of moveable body section 12. Rail clamping member 42 is placed abutting standard rail section 20 and body section 12 and all three are bolted together. A second standard rail section 20 is secured to fixed point section 14 in the same manner. Spring clips 66 are then driven into each shoulder plate 64 of each quick release fastener 60 to secure the remaining portions of moveable body section 12 and fixed point section 14 and secure standard rail sections 20 to base plates 16, 18.

The present invention has many significant advantages. The present invention employs a base plate which is separate from the bridge joint sections. The bridge joint sections are not attached to the base plates with through bolts, thus do not require access to the bottom side of the plates for removal. Bridge joint sections can be removed with simple hand tools leaving the base plates in position. Further, there are no welds that must be ground to release the bridge joint sections.

While the invention has been shown in only one of its forms, it should be apparent to those skilled in the art that it is not so limited, but is susceptible to various changes without departing from the scope of the invention.

I claim:

1. A bridge joint for use with a railroad track having standard rail sections, said bridge joint comprising:

a first and second planar base plates;

a point section on said first base plate, said point section having a forward integral accepting portion with a point and flanges rearward of said accepting portion, said accepting portion having a pair of upward facing side-by-side cavities separated by said point;

a body section on said second base plate, said body section having a forward interface portion adapted to be slidingly accepted in said cavities of said accepting portion, an accepting notch adapted to accept said point, and flanges rearward of said interface portion; and a plurality of fasteners secured to said base plates for engaging said flanges and securing said point section to said first base plate and said body section to said second base plate, each of said fasteners having a fastener base that is secured to one of the base plates and a lock member carried by the fastener base for locking one of the flanges to the base, the lock member having a lower end located above the base plate and being capable of being tightened and released entirely from an upper side of the base plate without requiring access to a lower side of the base plate.

2. The bridge joint of claim 1, wherein at least some of said flanges comprise spaced-apart lugs integrally formed on said body section and said point section.

3. The bridge joint of claim 1, wherein at least some of said lock members comprise:

a bolt having a head located within a recess on a bottom surface of said fastener base, said bolt extending upward through a hole in said base;

a clamp member in engagement with one of said flanges and located on top of said fastener base; and a nut engaging said bolt to secure said clamp member to said fastener base.

4. The bridge joint of claim 1, wherein at least some of said fasteners comprise:

a shoulder plate on top of said fastener base and in engagement with one of said flanges; and a spring clip that engages said shoulder plate and said flange.

5. The bridge joint of claim 1, wherein said body section comprises a body member alongside a guard member, said body member and said guard member being integrally formed and having inner and outer sidewalls with an inner web located therebetween, defining a pair of downward-facing cavities extending to lower end of said body section.

6. The bridge joint of claim 1 wherein:

said point section has a rearward standard rail mating portion adapted to laterally abut and join with one of said standard rail sections, said mating portion of said point section including a pair of lateral projections, spaced one above the other, that extend into abutment with a web of one of said standard rail sections; and said body section has a rearward standard rail mating portion adapted to laterally abut and join with one of said standard rail sections, said mating portion of said body section including a pair of lateral projections, spaced one above the other, that extend into abutment with a web of the other of said standard rail sections.

7. The bridge joint of claim 1 wherein said forward accepting portion has spaced side walls positioned closely adjacent said interface portion, and a forward end of said forward accepting portion terminates at a forward end of said point.

8. A bridge joint for use with a railway, said railway having a pair of parallel standard rails, said joint comprising:

a first and a second planar base plate;

a point section on said first base plate, said point section having a forward integral accepting portion with a point and a rearward standard rail mating portion for joining to one of said standard rails, said accepting portion having a pair of upward facing side-by-side cavities separated by said point;

a body section on said second base plate, said body section having a forward interface portion adapted to be slidingly accepted in said cavities of said accepting portion, a notch in said interface portion adapted to accept said point, and a rearward standard rail mating portion for joining to one of said standard rails;

a plurality of spaced-apart clamping lugs integrally formed on said point section and said body section; and a plurality of clamps secured to said base plates and corresponding to said clamping lugs for engaging said clamping lugs and securing said point section to said first base plate and said body section to said second base plate, each of said clamps comprising a fastener base secured to one of said base plates, a clamp member overlying said clamp base and engaging one of said clamping lugs, a bolt protruding upward through holes in said fastener base and in said clamp member, said bolt having a lower end located on an upper side of said base plate, and a nut engaging said bolt to secure said clamp member to said clamp base.

9. The bridge joint of claim 8 wherein said clamping lugs are on said accepting portion.

10. The bridge joint of claim 8 wherein said clamping lugs are on said interface portion.

11. The bridge joint of claim 8 wherein said accepting portion has spaced side walls positioned closely adjacent said interface portion.

12. The bridge joint of claim 8 wherein:

said point section has flanges rearward of said accepting portion;

said body section has flanges rearward of said interface portion; and said base plates have quick release fasteners secured thereto, said quick release fasteners having spring clips for engaging said flanges and securing said point section to said first base plate and said body section to said second base plate.

13. The bridge joint of claim 12 wherein said standard rail sections have flanges and said base plates have quick release fasteners for engaging said flanges and securing said standard rail sections to said base plates, said quick release fasteners having spring clips for engaging said flanges of said standard rail sections.

14. The bridge joint of claim 12 wherein said quick release fasteners have a base secured to said base plates, and said flanges have notches adapted to engage said base of said quick release fasteners.

15. The bridge joint of claim 8 wherein said standard rail sections have flanges and said base plates have quick release fasteners for engaging said flanges and securing said standard rail sections to said base plates, said quick release fasteners having spring clips for engaging said flanges of said standard rail sections.

16. A method of installing a bridge joint in a railway bridge between a movable section and a stationary section, said railway bridge having standard rail sections with flanges, comprising the steps of:

providing a point section having an accepting portion, a standard rail mating portion, and flanges, a body section having an interface portion with a notch, a standard rail mating portion, and flanges, and first and second base plates, said accepting portion having a pair of upward facing side-by-side cavities separated by said point;

securing one of said base plates to said movable section and the other of said base plates to said stationary section;

securing a plurality of fastener bases to said base plates;

placing said interface portion in said cavities of said accepting portion and said point in said notch;

securing one of said standard rail sections to said mating portion of said point section and securing another of said standard rail sections to said mating portion of said body section;

positioning said point section and joined standard rail section on said first base plate and said body section and joined standard rail section on said second base plate;

mounting fasteners to said fastener bases such that lower ends of said fasteners are located on an upper side of said base plates;

fastening with said fasteners said accepting portion to said first base plate and said interface portion to said second base plate; and fastening said point section, said body section, and said standard rail sections to said base plates with said fasteners by manipulating said fasteners entirely from above said base plates without requiring access to below said base plates.

* * * * *